US007192124B2

(12) United States Patent
Kojima

(10) Patent No.: US 7,192,124 B2
(45) Date of Patent: Mar. 20, 2007

(54) PIEZOELECTRIC ACTUATOR

(75) Inventor: Masatomo Kojima, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 366 days.

(21) Appl. No.: 10/794,329

(22) Filed: Mar. 5, 2004

(65) Prior Publication Data

US 2004/0174415 A1 Sep. 9, 2004

(30) Foreign Application Priority Data

Mar. 6, 2003 (JP) ..... 2003-059886

(51) Int. Cl.
*B41J 2/045* (2006.01)

(52) U.S. Cl. ..... 347/72

(58) Field of Classification Search ..... 347/68–72
See application file for complete search history.

(56) References Cited

U.S. PATENT DOCUMENTS

| | | | | |
|---|---|---|---|---|
| 4,766,671 | A | 8/1988 | Utsumi et al. | |
| 6,142,612 | A | 11/2000 | Whitman | |
| 6,142,614 | A | 11/2000 | Hashizume et al. | |
| 6,575,565 | B1 | 6/2003 | Isono et al. | |
| 6,913,349 | B2 * | 7/2005 | Hirota | 347/72 |
| 2002/0089572 | A1 * | 7/2002 | Lin et al. | 347/68 |
| 2002/0140787 | A1 | 10/2002 | Takahashi | |

FOREIGN PATENT DOCUMENTS

| | | |
|---|---|---|
| JP | 7-96301 | 1/1988 |
| JP | 04-141431 | 5/1992 |
| JP | 10-211701 | 11/1997 |
| JP | 2001-526465 | 6/1999 |
| JP | 2000-127380 | 5/2000 |
| JP | 2001-162796 | 6/2001 |
| JP | B2-7-96301 | 10/2001 |
| JP | 2002-355981 | 3/2002 |
| JP | 2002-127408 | 5/2002 |

* cited by examiner

*Primary Examiner*—K. Feggins
(74) *Attorney, Agent, or Firm*—Reed Smith LLP

(57) ABSTRACT

A piezoelectric actuator disposed to face a plurality of pressure chambers, the piezoelectric actuator including a plurality of piezoelectric layers and a plurality of electrode layers which are alternately stacked on each other; and a plurality of active portions which are provided in the piezoelectric layers to be aligned with the pressure chambers, respectively, and are defined between at least one pair of electrode layers that are opposed to each other in a direction of stacking of the piezoelectric layers and the electrode layers, the active portions being deformed when an electric voltage is applied to the electrode layers, the electrode layers including (a) at least one individual-electrode layer including a plurality of individual electrodes which are aligned with the pressure chambers, respectively, (b) at least one first common-electrode layer including a plurality of first common electrodes which are maintained at a common electric potential and are aligned with the pressure chambers, respectively, and (c) at least one second common-electrode layer including at least one second common electrode which is maintained at the common electric potential and is opposed commonly to the plurality of pressure chambers.

21 Claims, 7 Drawing Sheets

PIEZOELECTRIC ACTUATOR

BACKGROUND OF THE INVENTION

FIELD OF THE INVENTION

The present invention relates to a sheet-type piezoelectric actuator that includes a plurality of piezoelectric sheets stacked on each other.

There is known an on-demand-type ink jet printer head employing the above-indicated sheet-type piezoelectric actuator. The known printer head additionally employs a cavity unit having a plurality of ink chambers (i.e., a plurality of pressure chambers) to which a plurality of portions of the piezoelectric actuator are opposed, respectively. When each of those portions of the piezoelectric actuator is deformed, i.e., expanded and contracted, the volume of a corresponding one of the ink chambers is decreased and accordingly a droplet of ink is ejected from a nozzle communicating with the ink chamber.

Document 1 (i.e., Japanese Patent Application Publication P2001-162796A or its corresponding U.S. Pat. No. 6,575,565) or Document 2 (Japanese Patent Document No. 7-96301 B2) discloses such an example of the piezoelectric actuator that includes a plurality of piezoelectric layers which are each formed of a piezoelectric ceramic material and are stacked on each other; and a plurality of electrode layers which are formed on respective surfaces of the piezoelectric layers and each pair of which cooperate with each other to sandwich a corresponding one of the piezoelectric layers. In the prior piezoelectric actuator, the each pair of electrode layers consist of an individual-electrode layer including a plurality of individual electrodes that are opposed to the ink chambers, respectively, and a common-electrode layer that is electrically common to the ink chambers, and the individual-electrode layers and the common-electrode layers are alternate with each other in the direction of stacking of the piezoelectric layers. When an electric voltage is applied to an arbitrary one of the individual electrodes of the each pair of electrode layers and the common-electrode layer thereof, a portion of the piezoelectric layer that is sandwiched by the each pair of electrodes is expanded and contracted.

More specifically described, in the piezoelectric actuator disclosed by Document 1, the individual electrodes are formed such that the individual electrodes are independent of, and separate from, each other, and are opposed to the ink chambers, respectively. On the other hand, the common-electrode layer is formed to include a wide portion that extends over the ink chambers adjacent to each other and is common to the ink chambers.

Meanwhile, in the piezoelectric actuator disclosed by Document 2, the common-electrode layer includes, like the individual-electrode layer including the individual electrodes, a plurality of common electrodes that are opposed to the ink chambers, respectively. Each of the common electrodes has the same shape as that of each of the individual electrodes, and is aligned with a corresponding one of the individual electrodes in the direction of stacking of the piezoelectric layers. However, the common electrodes are connected to external electrode terminals that are provided in a pattern different from a pattern in which external electrode terminals to which the individual electrodes are connected are provided.

In the piezoelectric actuator disclosed by Document 1, the common electrode has a large area, which leads to increasing an electrostatic capacity of the individual electrodes and the common electrode, thereby increasing an electric power consumption of the actuator, and needing an electric-power supply unit having a large capacity. Thus, the cost of the piezoelectric actuator is increased. In addition, generally, the individual electrodes and the common electrode are formed of silver-palladium alloy, but palladium is a rare metal and is very expensive. In fact, the palladium alloy occupies about 70% of the cost of materials of the piezoelectric actuator. Since the wide common electrode employed by the piezoelectric actuator disclosed by Document 1 has the large area, it needs a large amount of palladium-alloy material. Hence, Document 2 proposes to employ the common electrodes each having the same shape as that of each individual electrode in an area around each ink chamber, and thereby decrease the total areas of the common electrodes and the cost of material (e.g., palladium alloy) of the same and accordingly decrease the electrostatic capacity of the piezoelectric actuator and the cost of the actuator and the power supply unit.

However, if each of the common electrodes has the same shape as that of a corresponding one of the individual electrodes in an area around a corresponding one of the ink chambers, then an electric field produced between the each common electrode and the one individual electrode may leak to outside the piezoelectric actuator, and consequently the ink accommodated in the one ink chamber may be electrically charged, or a signal line connected to the one individual electrode may be adversely influenced, so that a droplet of ink may not be normally ejected from the one ink chamber.

Moreover, since the individual and common electrodes are present in only the area around each ink chamber, the piezoelectric actuator has an increased thickness in only the area around the each ink chamber.

A certain amount of displacement or deformation of the piezoelectric actuator is needed to eject the droplet of ink. To this end, the actuator employs a certain number of stacked piezoelectric layers each of which is sandwiched by a pair of electrode layers, i.e., an individual-electrode layer and a common-electrode layer. However, as the total number of the piezoelectric layers increases, the difference between the thickness of respective portions of the actuator that correspond to the ink chambers and the thickness of the remaining portion of the actuator increases.

Thus, opposite major surfaces of the piezoelectric actuator may have warpage or unevenness that damages the adhesion of the actuator to the cavity unit having the ink chambers or causes other defects of the actuator as an end product.

SUMMARY OF THE INVENTION

It is therefore an object of the present invention to provide a piezoelectric actuator that is freed of at least one of the above-identified problems, e.g., enjoys at least one of the following advantages that the cost of materials of electrodes can be reduced, that the leakage of electric field can be prevented, and that the warpage or unevenness of the actuator as a whole can be minimized.

This object may be achieved by the present invention according to which there is provided a piezoelectric actuator disposed to face a plurality of pressure chambers, the piezoelectric actuator including a plurality of piezoelectric layers and a plurality of electrode layers which are alternately stacked on each other; and a plurality of active portions which are provided in the piezoelectric layers to be aligned with the pressure chambers, respectively, and are defined between at least one pair of electrode layers that are opposed to each other in a direction of stacking of the piezoelectric layers and the electrode layers, the active portions being deformed when an electric voltage is applied to the electrode layers, the electrode layers including (a) at least one individual-electrode layer including a plurality of individual electrodes which are aligned with the pressure chambers, respectively, (b) at least one first common-electrode layer including a plurality of first common electrodes which are maintained at a common electric potential and are aligned with the pressure chambers, respectively, and (c) at least one second common-electrode layer including at least one second common electrode which is maintained at the common electric potential and is opposed commonly to the plurality of pressure chambers.

Each of the piezoelectric layers may be provided by a single piezoelectric sheet, or two or more piezoelectric sheets stacked on each other. The second common-electrode layer may include a single second common electrode that is opposed commonly to the plurality of pressure chambers, or two or more second common electrodes which are opposed to the plurality of pressure chambers.

According to this invention, the first common-electrode layer includes the plurality of first common electrodes that are maintained at the common electric potential and are aligned with the plurality of pressure chambers, respectively. Therefore, the total area of the first common electrodes can be made smaller than the area of a single electrode that is opposed commonly to the plurality of pressure chambers, e.g., the area of the second common electrode. Since the present piezoelectric actuator employs the first and second common-electrode layers in combination, an overall electrostatic capacity of those electrode layers can be reduced. In addition, the cost of materials of the electrode layers can be lowered. Moreover, an electric field produced between each of the individual electrodes and the first and second common-electrode layers can be prevented from leaking to outside the piezoelectric actuator, and accordingly the fluid (e.g., ink) accommodated in a corresponding one of the pressure chambers can be prevented from being electrically charged, and a signal line used to supply electricity to the each individual electrode can be prevented from being adversely influenced by the electric field. Thus, the ink can be stably ejected from the pressure chamber.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings. A piezoelectric-type ink jet printer head as a first embodiment of the present invention includes a cavity unit and a piezoelectric actuator.

Figure 1:
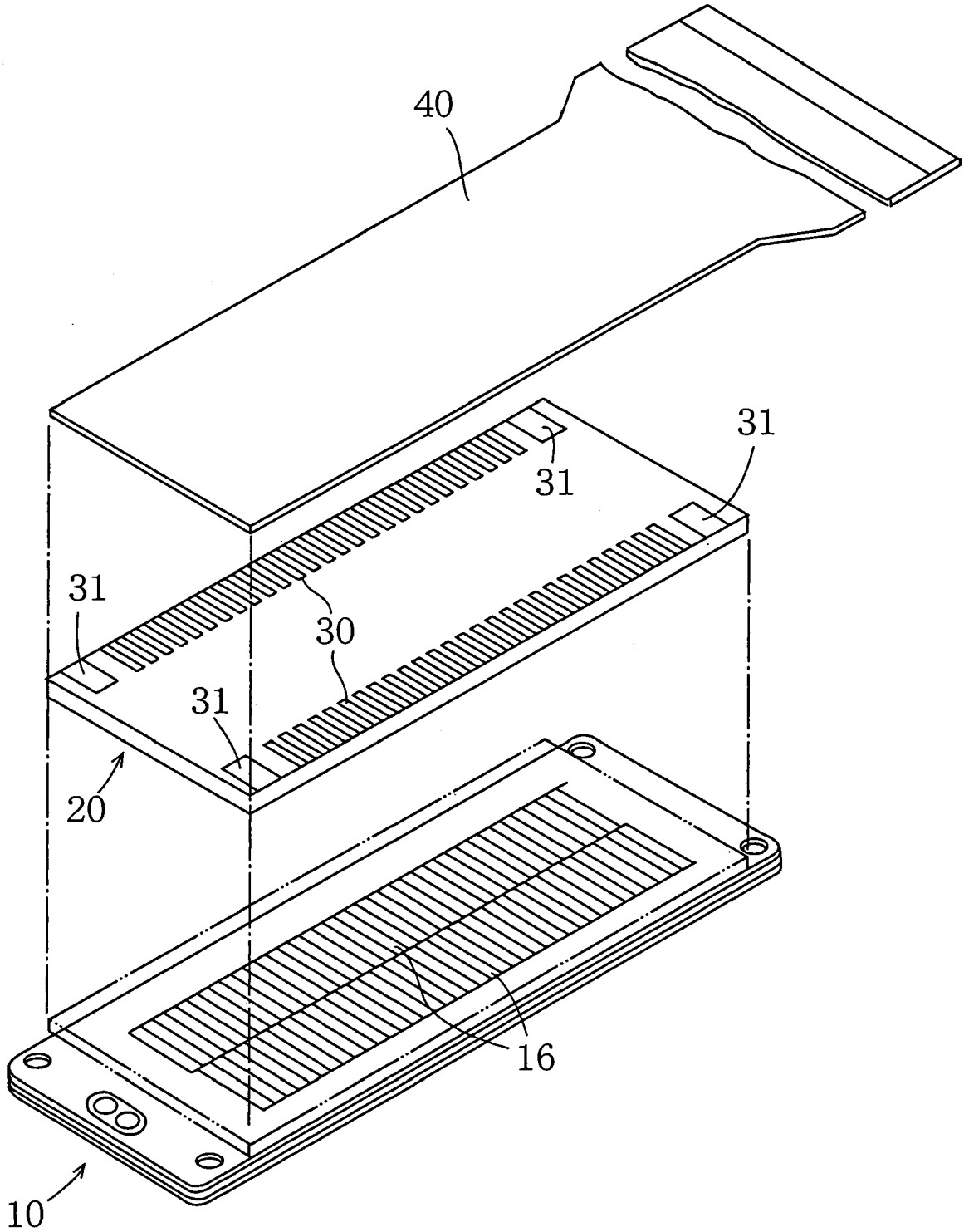
FIG. 1 is an exploded, perspective view of a piezoelectric-type ink jet printer head to which the present invention is applied.

More specifically described, as shown in FIG. 1, the piezoelectric ink jet printer head includes a cavity unit 10; a sheet-type piezoelectric actuator 20 that is bonded to the cavity unit 10; and a flexible flat cable 40 that is stacked on, and bonded to, an upper surface of the piezoelectric actuator 20, for connecting the actuator 20 to an external device, not shown. The ink jet printer head ejects a droplet of ink in a downward direction from each of ink ejection nozzles 15 (FIG. 3) that are open in a lower surface of the cavity unit 10 as the lowermost layer of the printer head.

Figure 3:
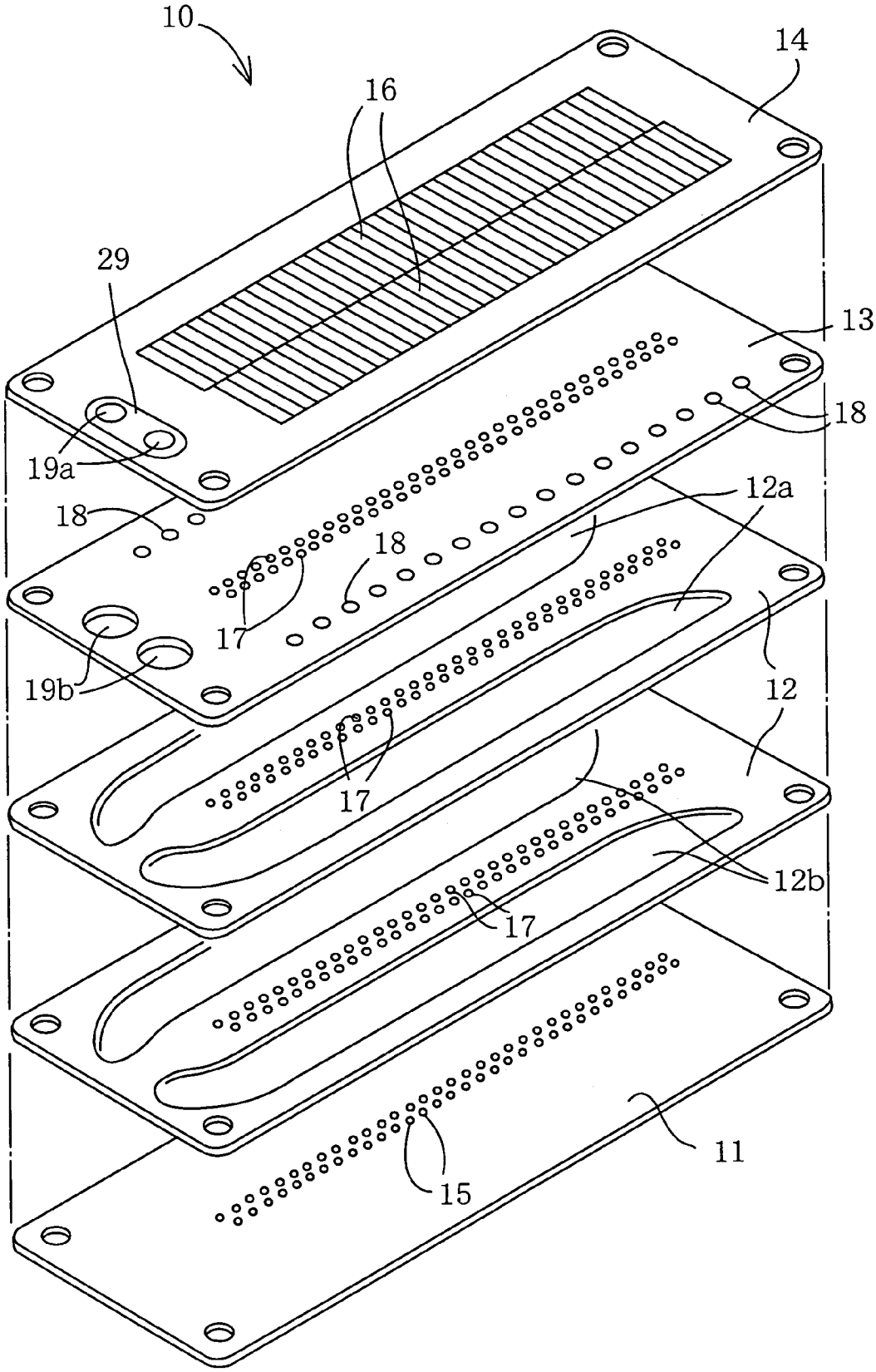
FIG. 3 is an exploded, perspective view of the cavity unit.
Figure 4:
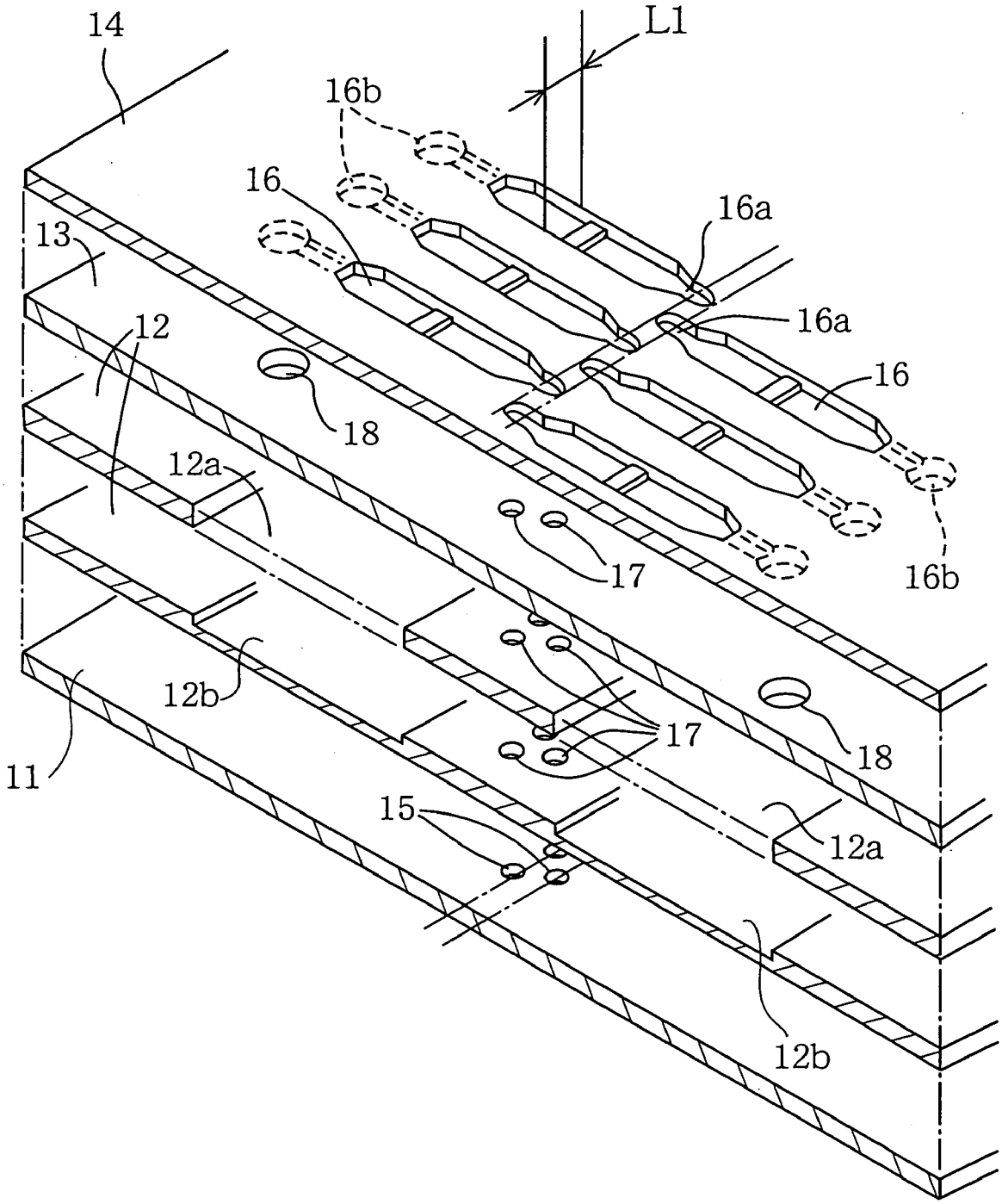
FIG. 4 is an enlarged, perspective view of a portion of the cavity unit.

As shown in FIGS. 3 and 4, the cavity unit 10 includes five thin sheets that are stacked on each other. The five thin sheets include a nozzle sheet 11, two manifold sheets 12, 12, a spacer sheet 13, and a base sheet 14.

In the present embodiment, the four sheets 12, 12, 13, 14, except for the nozzle sheet 11, are each formed of a 42% nickel alloy steel sheet, and have respective thickness values which fall in the range of from 50 μm to 150 μm. The nozzle sheet 11 is formed of a synthetic resin, and has two arrays of ink ejection nozzles 15 that are arranged in a staggered or zigzag fashion, at a regular small interval of distance in each array, in a first direction (i.e., a lengthwise direction) of the cavity unit 10 or the printer head. Each of the nozzles 15 is formed through the thickness of the nozzle sheet 11, and has a small diameter (e.g., 25 μm).

An upper one of the two manifold sheets 12, 12 has two first common ink passages 12*a*, 12*a* that are formed through the thickness of the upper manifold sheet 12, such that the two first common ink passages 12*a*, 12*a* extend along, and outside, the two arrays of nozzles 15, respectively, i.e., in the first direction of the cavity unit 10. The lower manifold sheet 12 has two second common ink passages 12*b*, 12*b* that are open in only an upper surface thereof, are aligned with the two first common ink passages 12*a*, 12*a*, respectively, and have substantially the same shape as that of the first common ink passages 12*a*, 12*a*. Each of the two second common ink passages 12*b*, 12*b* cooperates with a corresponding one of the two first common ink passages 12*a*, 12*a* to define a corresponding one of two common ink manifolds 12*a*, 12*b*; 12*a*, 12*b*. The two common ink manifolds 12*a*, 12*b*; 12*a*, 12*b* are fluid-tightly closed by the spacer sheet 13 stacked on the upper manifold sheet 12.

The base sheet 14 has two arrays of ink chambers (i.e., pressure chambers) 16 that are formed therein such that each of the ink chambers 16 is elongate in a second direction (i.e., a widthwise direction) of the cavity unit 10 or the printer head that is perpendicular to the first direction (i.e., the lengthwise direction) of the unit 10 or the head. The two arrays of ink chambers 16 are arranged in a zigzag fashion in the first direction. Each of the ink chambers 16 has, at an intermediate portion thereof, a width, L1, as shown in FIG. 4.

Figure 2:
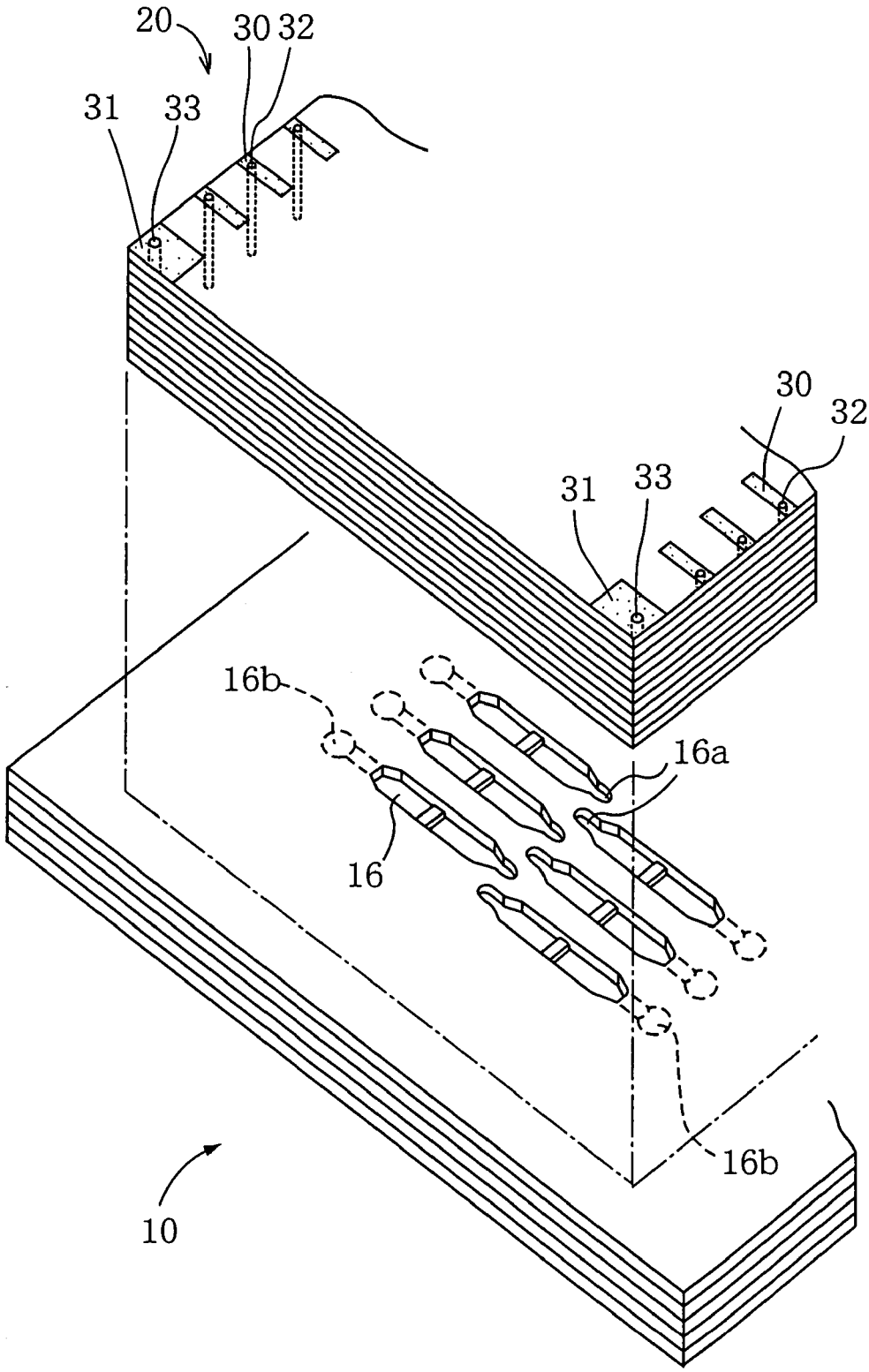
FIG. 2 is an enlarged, perspective view of respective end portions of a cavity unit and a piezoelectric actuator of the printer head.

As shown in FIGS. 2 and 4, respective inner end portions 16*a* of the ink chambers 16, formed in the zigzag fashion in the base sheet 14, are located in a widthwise middle portion of the base sheet 14, and communicate with the respective nozzles 15, also formed in the zigzag fashion in the nozzle sheet 11, via respective through-holes 17 each of which has a small diameter and which are formed through the thickness of each of the spacer sheet 13 and the two manifold sheets 12, 12. The through-holes 17 provide respective ink channels connecting between the ink chambers 16 and the corresponding nozzles 15.

On the other hand, respective outer end portions 16*b* of the ink chambers 16 of one of the two arrays communicate with a corresponding one of the two common ink manifolds 12*a*, 12*b*; 12*a*, 12*b* of the two manifold sheets 12, 12 via a corresponding one of two arrays of through-holes 18 that are formed through the thickness of the spacer sheet 13; and respective outer end portions 16*b* of the ink chambers 16 of the other array communicate with the other common ink manifold 12*a*, 12*b* via the other array of through-holes 18 of the spacer sheet 13. As shown in FIG. 4, the other end portions 16*b* of the ink chambers 16 open in only a lower surface of the base sheet 14. In addition, as shown in FIG. 3, the base sheet 14 as the uppermost layer of the cavity unit 10 has, in one of lengthwise opposite end portions thereof, two first ink supply holes 19*a* that are formed through the thickness of the base sheet 14 and communicate with the two first common ink passages 12*a*, 12*a* of the upper manifold sheet 12, respectively; and the spacer sheet 13 has, in one of lengthwise opposite end portions thereof, two second ink supply holes 19*b* that are formed through the thickness of the spacer sheet 13 and communicate with the two first common ink passages 12*a*, 12*a* of the upper manifold sheet 12, respectively. The two first ink supply holes 19*a* of the base sheet 14 as the uppermost layer are equipped with a filter 29 that removes dust from respective inks supplied from two ink tanks, not shown, located above the base sheet 14.

The respective inks supplied from the two ink tanks to the two common ink manifolds 12*a*, 12*b*; 12*a*, 12*b* via the ink supply holes 19*a*, 19*b* of the base sheet 14 and the spacer sheet 13, are delivered to the ink chambers 16 via the respective through-holes 18, and then reach, via the through-holes 17, the ink ejection nozzles 15 that communicate with the ink chambers 16, respectively.

Figure 5:
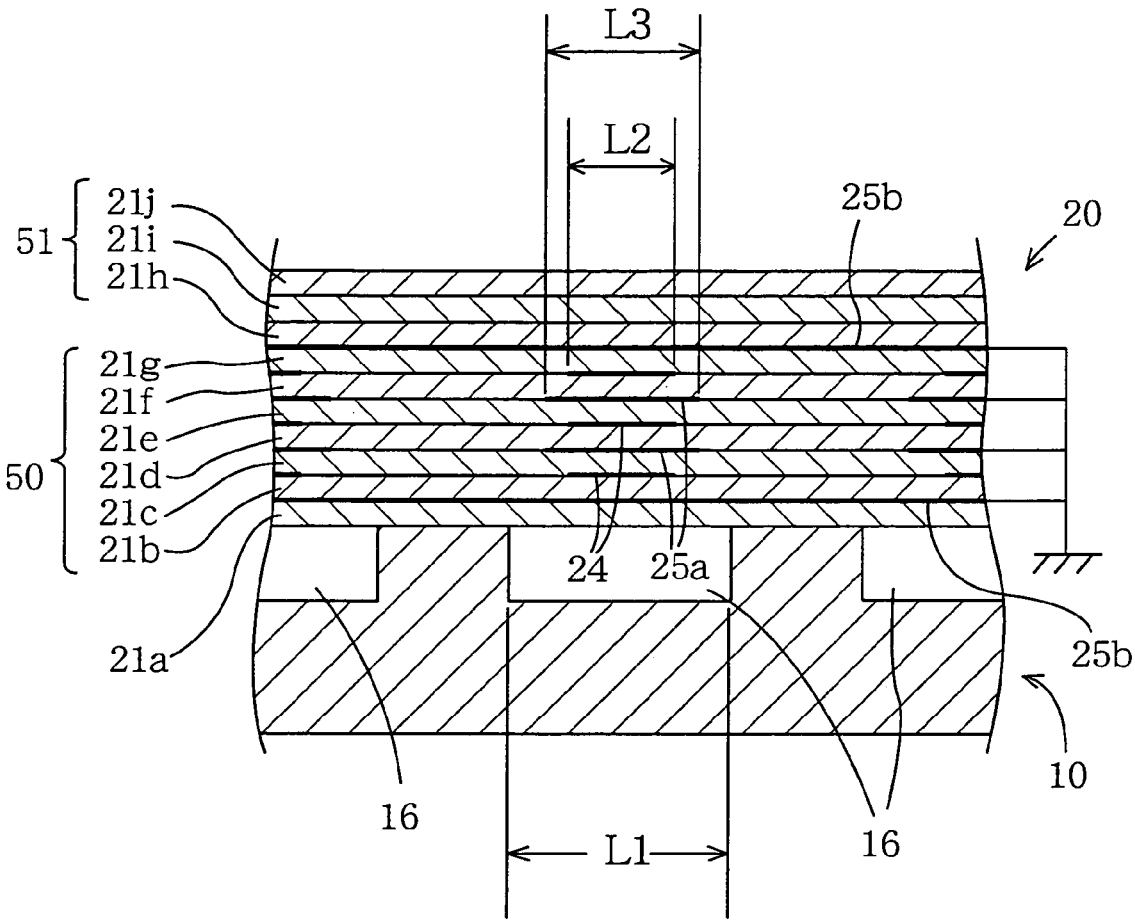
FIG. 5 is a longitudinal cross-section view of a portion of the printer head.

The piezoelectric actuator 20 includes a plurality of piezoelectric layers and a plurality of electrode layers that are alternately stacked on each other. Each of the piezoelectric layers includes a piezoelectric sheet formed of a piezoelectric material such as a piezoelectric ceramic. In the present embodiment, as shown in FIG. 5, the piezoelectric actuator 20 has a construction in which ten piezoelectric sheets 21*a*, 21*b*, 21*c*, 21*d*, 21*e*, 21*f*, 21*g*, 21*h*, 21*i*, 21*j* are stacked on each other. Each of the electrode layers consists of a metallic film or films formed on an upper, major surface of a corresponding one of the piezoelectric sheets 21 (21*a* to 21*j*), in a manner described later.

The second through seventh piezoelectric sheets 21*b*, 21*c*, 21*d*, 21*e*, 21*f*, 21*g*, as counted in an upward direction from the cavity unit 10, cooperate with each other to provide an active layer 50 including a plurality of active portions which correspond to the ink chambers 16, respectively, and each of which can be deformed, i.e., expanded and contracted to change a volume of a corresponding one of the ink chambers 16 and thereby eject a droplet of ink from a corresponding one of the nozzles 15. The eighth through tenth piezoelectric sheets 21*h*, 21*i*, 21*j*, as counted in the same direction, cooperate with each other to provide a restrictive layer 51 including a plurality of restrictive portions which restrict respective upward deformation of the active portions of the active layer 50.

Figure 6:
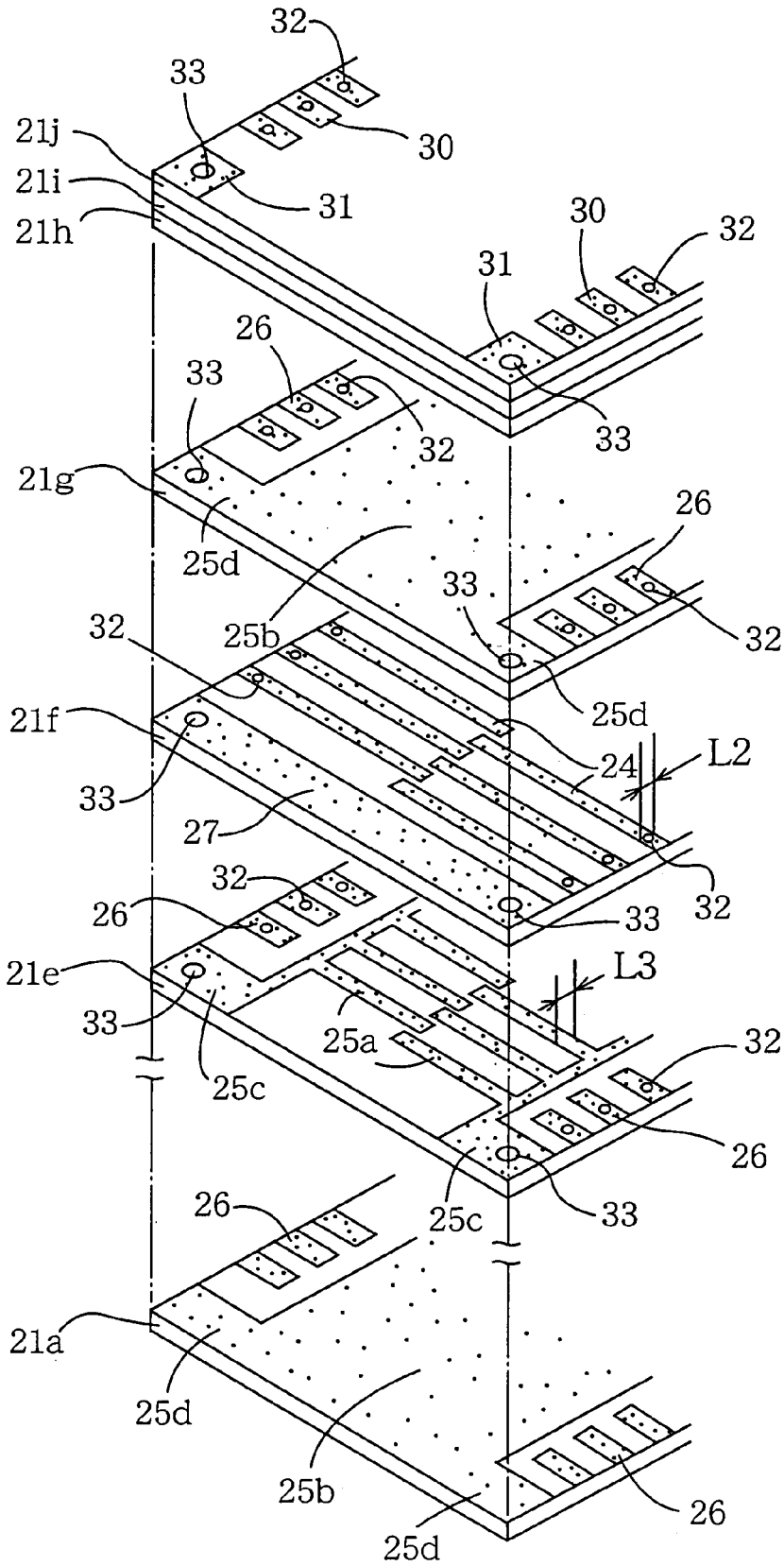
FIG. 6 is an exploded, perspective view of the piezoelectric actuator.

The active layer 50 includes two sorts of electrode layers that are alternate with each other in the direction of stacking of the piezoelectric sheets 21. As shown in FIGS. 5 and 6, each of the three electrode layers of the first sort includes a plurality of proper individual electrodes 24 which correspond to the plurality of ink chambers 16, respectively, and to each of which an electric voltage is applied to eject a droplet of ink from a corresponding one of the ink chambers 16; and each of the two electrode layers of the second sort includes a first proper common electrode 25*a*, 25*c* including a plurality of portions 25*a* which correspond to the plurality of ink chambers 16, respectively, and are kept at a common electric potential. The active layer 50 additionally includes a third sort of electrode layer that is provided on each of the uppermost piezoelectric sheet 21*g* of the active layer 50 and the lowermost piezoelectric sheet 21*a* of the actuator 20. Each of the two electrode layers of the third sort includes a second proper common electrode 25*b*, 25*d* which includes a wide portion 25*b* that is so wide as to extend over the two arrays of ink chambers 16, and which is kept at the above-indicated common electric potential at which the two first proper common electrodes 25*a*, 25*c* are kept.

More specifically described, on an upper surface of each of the second, fourth, and sixth piezoelectric sheets 21*b*, 21*d*, 21*f* as counted in the upward direction, there is provided the above-indicated proper individual electrodes 24, such that the proper individual electrodes 24 are aligned with the ink chambers 16 of the cavity unit 10, respectively.

In addition, on an upper surface of each of the third and fifth piezoelectric sheets 21*c*, 21*e* as counted in the same direction, there is provided the above-indicated first proper common electrode 25*a*, 25*c*; and, on an upper surface of each of the first and seventh piezoelectric sheets 21*a*, 21*h*, there is provided the above-indicated second proper common electrode 25*b*, 25*d*.

In the present embodiment, as shown in FIG. 6, the proper individual electrodes 24 of each electrode layer of the first sort are independent of each other, and are arranged in two arrays in a zigzag fashion in a first direction (i.e., a lengthwise direction) of the piezoelectric actuator 20 or the printer head. Each of the proper individual electrodes 24 is elongate corresponding to the elongate shape of each ink chamber 16, and extends in a second direction perpendicular to the first direction, so as to reach a corresponding one of two long sides of the corresponding piezoelectric sheet 21*b*, 21*d*, 21*f*. As shown in FIG. 5, each proper individual electrode 24 has a width, L2, that is smaller than the width L1 of each ink chamber 16 (i.e., L2<L1). However, the width L2 of each proper individual electrode 24 may be equal to the width L1 of each ink chamber 16 (i.e., L2=L1).

The first proper common electrode 25*a*, 25*c* as each electrode layer of the second sort includes the plurality of elongate portions 25*a* which correspond to the plurality of ink chambers 16, respectively, and are arranged in two arrays in a zigzag fashion in the first direction of the piezoelectric actuator 20 and each of which extends in the second direction of the same 20. Respective outer end portions of the elongate portions 25*a* of each of the two arrays are connected to each other in the first direction, and are additionally connected to two lead portions 25*c* as part of the first proper common electrode 25*a*, 25*c* that are provided on lengthwise opposite end portions of the corresponding piezoelectric sheet 21*c*, 21*e*. That is, the two arrays of elongate (or "branch") portions 25*a* and the four lead portions 25*c* are electrically integrated to provide the first proper common electrode 25*a*, 25*c*. As shown in FIG. 5, each of the elongate or branch portions 25*a* of the first proper common electrode 25*a*, 25*c* as each electrode layer of the second sort has a width, L3, that is greater than the width L2 of each proper individual electrode 24 (i.e., L3>L2) and is not greater than the width L1 of each ink chamber 16 (i.e., L3≦L1), and it overlaps, in its plan view, the corresponding, three proper individual electrodes 24, the corresponding elongate or branch portion 25*a* of the other first proper common electrode 25*a*, 25*c*, and the corresponding ink chamber 16.

Meanwhile, the wide portion 25*b* of the second proper common electrode 25*b*, 25*d* as each electrode layer of the third sort has, in its plan view, a rectangular shape that extends, on a widthwise middle portion of the corresponding piezoelectric sheet 21*a*, 21*g*, in the lengthwise direction of the same 21*a*, 21*g*, such that the wide portion 25*b* extends over all the ink chambers 16 that are arranged, in the widthwise middle portion of the cavity unit 10, in the two arrays in the first direction (i.e., the lengthwise direction) of the same 10. The wide portion 25*b* is integral with two lead portions 25*d*, 25*d* that are provided on the lengthwise opposite end portions of the corresponding piezoelectric sheet 21*a*, 21*g*, respectively, so as to provide the second proper common electrode 25*b*, 25*d*. The two lead portions 25*d*, 25*d* extend over the respective entire lengths of the two opposite end portions of the piezoelectric sheet 21*a*, 21*g*, in the second direction of the piezoelectric actuator 20. The two first proper common electrodes 25*a*, 25*c* and the two second proper common electrodes 25*b*, 25*d* are electrically connected to each other via an electrically conductive material filling through-holes 33 (FIG. 6) formed through the respective thickness of the piezoelectric sheets 21*b* through 21*g*, so that the first and second proper common electrodes 25*a*, 25*c*; 25*b*, 25*d* take the same electrical potential.

Each of the piezoelectric sheets 21*a*, 21*c*, 21*e*, 21*g* on which the first and second proper common electrodes 25*a*, 25*c*; 25*b*, 25*d* are provided, respectively, has, on the upper surface thereof, two widthwise opposite end areas which are free of the corresponding first or second proper common electrode 25*a*, 25*c*; 25*b*, 25*d* and on which two arrays of dummy individual electrodes 26 are provided, respectively. The dummy individual electrodes 26 are formed at respective positions that are aligned, in the direction of stacking of the piezoelectric sheets 21, with the proper individual electrodes 24 of each electrode layer of the first sort, respectively, and have a width substantially equal to that of the same 24 and a length smaller than that of the same 24.

On the upper surface of each of the second, fourth, and sixth piezoelectric sheets 21*b*, 21*d*, 21*f* on each of which the proper individual electrodes 24 are provided, there are provided two dummy common electrodes 27, 27 at respective positions that are aligned, in the direction of stacking of the piezoelectric sheets 21, with the two pairs of lead portions 25*c*, 25*c* of each first proper common electrode 25*a*, 25*c*, respectively, and the two lead portions 25*d*, 25*d* of each second proper common electrode 25*b*, 25*d*, respectively.

Each of the proper individual electrodes 24 and the first and second proper common electrodes 25*a*, 25*c*; 25*b*, 25*d* is formed, by screen printing, of an electrically conductive paste, i.e., a silver-palladium alloy, on the upper surface of a corresponding one of the piezoelectric sheets 21, such that the each electrode has a predetermined pattern and has a predetermined positional relationship with the corresponding piezoelectric sheet 21.

In a state in which a plurality of portions of each of the piezoelectric sheets 21*b*–21*g* of the active layer 50 are sandwiched by the proper individual electrodes 24 of each electrode layer of the first sort, the elongate portions 25*a* of the first proper common electrode 25*a*, 25*c* as each electrode layer of the second sort, and the wide portion 25*b* of the second proper common electrode 25*b*, 25*d* as each electrode layer of the third sort, the first and second proper common electrodes 25*a*, 25*c*; 25*b*, 25*d* are grounded in a manner known in the art via the electrically conductive material filling the through-holes 33. When a high positive electric voltage suitable for polarization is applied to all the proper individual electrodes 24, the above-indicated plurality of portions of each of the piezoelectric sheets 21*b*–21*g* are polarized, in a direction from the proper individual electrodes 24 toward the first or second proper common electrode 25*a*, 25*c*; 25*b*, 25*d*, so as to provide the above-described active portions of the active layer 50. Thus, the second to seventh piezoelectric layers 21*b* through 21*g* as counted in the upward direction from the cavity unit 10 provide the active layer 50. When the first and second proper common electrodes 25*a*, 25*c*; 25*b*, 25*d* are grounded in the manner known in the art and a positive low electric voltage suitable for driving is applied to an arbitrary one of the proper individual electrodes 24 of each electrode layer of the first sort, a corresponding one of the active portions of the active layer 50 is deformed, i.e., expanded and contracted owing to a longitudinal piezoelectric effect.

The restrictive layer 51 is for restricting the deformation of each of the active portions of the active layer 50 in the direction opposite to the direction toward a corresponding one of the ink chambers 16. On an upper surface of the piezoelectric sheet 21*j* as the uppermost layer of the three piezoelectric sheets 21*h*, 21*i*, 21*j* of the restrictive layer 51, there are provided two arrays of first surface electrodes 30 along two long sides of the sheet 21*j*, respectively, and two pairs of second surface electrodes 31 on lengthwise opposite end portions of the sheet 21*j*, respectively. The first surface electrodes 30 correspond to the proper individual electrodes 24 of each electrode layer of the first sort, respectively; and the second surface electrodes 31 correspond to the first and second proper common electrodes 25*a*, 25*c*; 25*b*, 25*d* as the electrode layers of the first and second sorts. On each of the piezoelectric sheets 21*i*, 12*h*, there are provided two arrays of dummy individual electrodes 26 (not shown) connecting between the dummy individual electrodes 26 provided on the underlying piezoelectric sheet 21*g*, and the first surface electrodes 30 provided on the uppermost piezoelectric sheet 21*j*, via an electrically conductive material filling through-holes 32 formed through the thickness of each of the sheets 21*j*, 21*i*, 21*h*; and two dummy common electrodes 27 (not shown) connecting between the two lead portions 25*d* of the second proper common electrode 25*b*, 25*d* provided on the underlying piezoelectric sheet 21*g*, and the two pairs of second surface electrodes 31 provided on the uppermost piezoelectric sheet 21*j*, via the electrically conductive material filling the through-holes 33 formed through the thickness of each of the sheet 21*j*, 21*i*, 21*h*.

Since each of the three piezoelectric sheets 21*h*, 21*i*, 21*j* of the restrictive layer 51 is not sandwiched by the proper individual electrodes 24 and the first or second proper common electrode 25*a*, 25*c*; 25*b*, 25*d*, no portions of the each sheet 21*h*–21*j* are polarized even if the polarizing electric voltage may be applied to the piezoelectric actuator 20, or are deformed even if the driving electric voltage may be applied to the same 20.

Generally, it is not needed to provide an electrode layer on each of the piezoelectric layers 21*i*, 21*h* of the restrictive layer 51. However, a piezoelectric sheet on which an electrode layer is not provided, and a piezoelectric sheet on which an electrode layer is provided exhibit, when they are fired, different shrinkage percentages, which lead to producing warpage or unevenness of the piezoelectric actuator 20 as an end product. To avoid this problem, it is possible to provide intentionally, on each of the piezoelectric sheets 21*i*, 21*h*, one or more additional electrodes in addition to the dummy individual and common electrodes 26, 27. However, if an electric potential is produced between the additional electrodes provided on the each sheet 21*i*, 21*h* and one or more electrodes that are opposed to the additional electrodes, then some electrostatic capacity is produced. Therefore, it is preferred to provide, on each of the piezoelectric sheets 21*i*, 21*h*, an electrode identical with that provided on the piezoelectric sheet 21*g*, i.e., the second proper common electrode 25*b*, 25*d*. However, it is possible to provide, on each of the piezoelectric sheets 21*i*, 21*h*, a different electrode.

Each of the piezoelectric sheets 21*b*–21*j*, except for the lowermost piezoelectric sheet 21*a*, has through-holes 32 that are formed through the thickness of the each sheet 21*b*–21*j*, such that an electrically conductive material filling the through-holes 32 electrically connect between the first surface electrodes 30 and the proper or dummy individual electrodes 24, 26 that are aligned with the first surface electrodes 30, respectively, in the direction of stacking of the sheets 21*a*–12*j*. Similarly, each of the piezoelectric sheets 21*b*–21*j*, except for the lowermost piezoelectric sheet 21*a*, has through-holes 33 that are formed through the thickness of the each sheet 21*b*–21*j*, such that an electrically conductive material filling the through-holes 33 electrically connect between the two pairs of second surface electrodes 31, and the two pairs of lead portions 25*c* of the first proper common electrodes 25*a*, 25*c*, the two lead portions 25*d* of the second proper common electrodes 25*b*, 25*d*, or the two dummy common electrodes 27, that are aligned with the two pairs of second surface electrodes 31, respectively.

When the present piezoelectric ink jet printer head is manufactured, first, ceramic green sheets corresponding to the ten piezoelectric sheets 21*a*–21*j* are formed, and then through-holes 32, 33 are formed through the thickness of each green sheet. In addition, when an electrode layer is formed, by screen printing, of an electrically conductive paste, i.e., a silver-palladium-alloy paste on each of the green sheets, the paste enters the through-holes 32, 33 of the each green sheet to fill the same 32, 33. Thus, the respective electrode layers formed on the green sheets can be electrically connected to each other via the paste filling the through-holes 32, 33. Then, the green sheets on which the electrode layers have been formed are stacked on each other such that the electrode layers are connected to each other via the paste filling the through-holes 32, 33, and a pressure is applied to the stacked sheets so as to provide an integral body. The integral body is fired in a known manner so as to provide a piezoelectric actuator 20.

The sheet-type piezoelectric actuator 20 constructed as described above is fixed, as shown in FIG. 5, to the cavity unit 10, such that the proper individual electrodes 24 each as the electrode layer of the first sort are aligned with the ink chambers 16 of the cavity unit 10, respectively. In addition, the flexible flat cable 40 is stacked and pressed on the upper surface of the piezoelectric actuator 20, so that various electric wirings (not shown) of the flat cable 40 are electrically connected to the first and second surface electrodes 30, 31 of the actuator 20.

When an electric voltage is applied to the three proper individual electrodes 24 and the first and second proper common electrodes 25*a*, 25*c*; 25*b*, 25*d* that correspond to an arbitrary one of the active portions of the active layer 50 of the piezoelectric actuator 20, the respective portions of the piezoelectric sheets 21*b*–21*g* that belong to the arbitrary active portion are deformed in the direction of stacking of the sheets 21*a*–21*g*. Since, however, the upward deformation of the active portion is restricted by the restrictive layer 51, the active portion is deformed or displaced largely on the side of the ink chamber 16 corresponding to the active portion, so that the volume of the ink chamber 16 is decreased and accordingly a droplet of ink is ejected from the nozzle 15 communicating with the ink chamber 16.

Since the cavity unit 10 is formed of a metal that is electrically conductive, it is preferred that the cavity unit 10 be grounded like the first and second proper common electrodes 25*a*, 25*c*; 25*b*, 25*d*.

In the piezoelectric actuator 20 constructed as described above, the first proper common electrode 25*a*, 25*c* provided on the upper surface of each of the piezoelectric sheets 21*c*, 12*e* includes, as shown in FIGS. 5 and 6, the elongate, branch portions 25*a* that are opposed to the proper individual electrodes 24, respectively. Therefore, the overall-all area of the first proper common electrode 25*a*, 25*c* is much smaller than that of the corresponding piezoelectric sheet 21*c*, 21*e*. Thus, an electrostatic capacity of each proper individual electrode 24 and the first proper common electrode 25*a*, 25*c* can be decreased, while the cost of material of the electrodes 25*a*, 25*c* can be reduced.

In addition, the width L3 of each elongate branch portion 25*a* of the first proper common electrode 25*a*, 25*c* is greater than the width L2 of each proper individual electrode 24. Therefore, even if, when the piezoelectric sheets 21 are stacked on each other, each elongate branch portion 25*a* of the first proper common electrode 25*a*, 25*c* may not be accurately aligned with the corresponding proper individual electrode 24, in the first direction of the piezoelectric actuator 20, the entirety of the proper individual electrode 24 can be opposed to the each branch portion 25*a*, if the positional error of the electrode 24 relative to the electrode 25*a* is smaller than the difference of the respective widths L2, L3. Accordingly, the corresponding active portion of the actuator 20 is deformed or displaced in the normal manner. Thus, when the piezoelectric sheets 21*a*–21*j* are stacked on each other, the sheets 21*a*–12*j* can be positioned relative to each other with a lower accuracy.

Moreover, the second proper common electrode 25*b*, 25*d* provided on each of the upper surface of the uppermost piezoelectric sheet 21*g* of the active layer 50 and the upper surface of the lowermost piezoelectric sheet 21*a* of the piezoelectric actuator 20 (i.e., the lower surface of the lowermost piezoelectric sheet 21*b* of the active layer 50), includes the wide portion 25*b* that is opposed to the plurality of ink chambers 16. Thus, the second proper common electrode 25*b*, 25*d* includes portions that are not opposed to any ink chambers 16, as shown in FIG. 5. Therefore, the electric field applied to each proper individual electrode 24 can be prevented from leaking to outside the piezoelectric actuator 20. Consequently the ink accommodated in each ink chamber 16 can be prevented from being electrically charged, and a signal line used to supply electricity to the each proper individual electrode 24 can be prevented from being adversely influenced. Thus, the ink can be normally and stably ejected from the each ink chamber 16.

In addition, the unevenness of the stacked body consisting of the stacked piezoelectric sheets 21*a*–21*j*, caused by the thickness of the electrodes 24, 25, 26, 27, is reduced by the provision of the second proper common electrodes 25*b*, 25*d*. Thus, the unevenness of the outer surfaces of the piezoelectric actuator 20 after firing can be reduced. In particular, since the second proper common electrodes 25*b*, 25*d* including the respective wide portions 25*b* are not provided between the intermediate layers of the stacked body but are provided on the uppermost and lowermost layers of the same so as to sandwich the same, the effect of reducing the unevenness of the stacked body is increased. Consequently the piezoelectric actuator 20 and the cavity unit 10 can be held in highly close contact with each other. Thus, the actuator 20 and the cavity unit 10 can be stably adhered to each other. It is possible that the second proper common electrode 25*b*, 25*d* be provided on only either one of the uppermost and lowermost layers 21*g*, 21*a* of the active layer 50. In the latter case, it is preferred that the second proper common electrode 25*b*, 25*d* be provided on the lowermost layers 21*a* of the active layer 50, for the purpose of improving the degree of close contact of the actuator 20 with the cavity unit 10.

Figure 7:
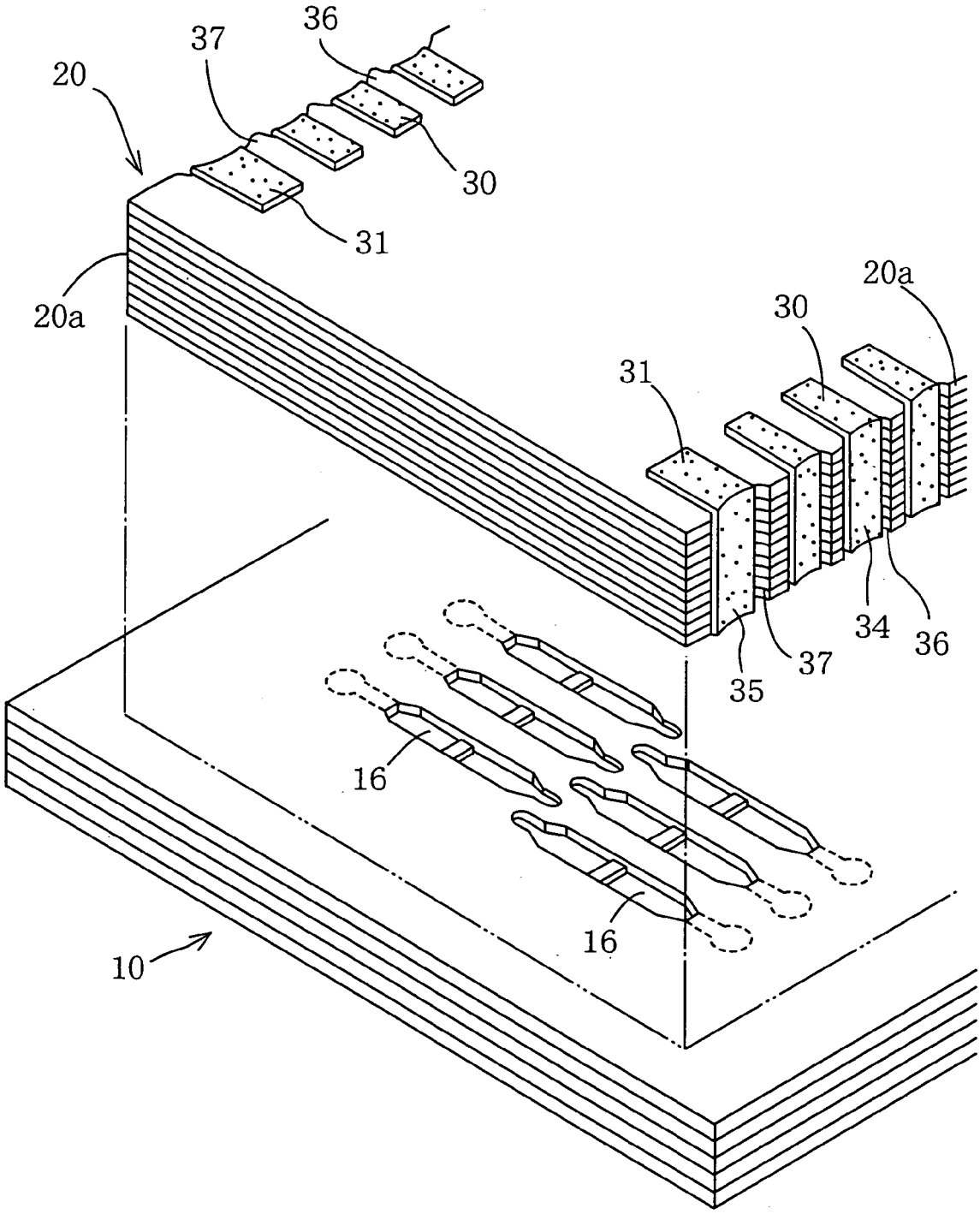
FIG. 7 is an enlarged, perspective view corresponding to FIG. 2, showing respective end portions of a cavity unit and a piezoelectric actuator of another piezoelectric-type ink jet printer head as a second embodiment of the present invention.

FIG. 7 shows a second embodiment of the present invention that also relates to a piezoelectric-type ink jet printer head. The same reference numerals as used in the first embodiment, shown in FIGS. 1 to 6, are used to designate the corresponding elements and parts of the second embodiment shown in FIG. 7. The ink jet printer head as the second embodiment has, in place of the through-holes 32, 33, first and second side electrodes 34, 35 on opposite long side surfaces 20*a* of a piezoelectric actuator 20 that is provided by a stacked body including a plurality of piezoelectric sheets stacked on each other. The opposite long side surfaces 20*a* are perpendicular to an upper surface of the actuator 20 on which first and second surface electrodes 30, 31 are provided. The first side electrodes 34 electrically connect between the first surface electrodes 30 and proper and dummy individual electrodes 24, 26 provided on respective intermediate piezoelectric sheets 21*b*–21*f*, and the second side electrodes 35 electrically connect between the second surface electrodes 31 and proper and dummy common electrodes 25 (25*a*, 25*c*; 25*b*, 25*d*), 27 provided on respective intermediate piezoelectric sheets 21*a*–21*g*. In this case, the piezoelectric actuator 20 has, in the side surfaces 20*a*, first and second side grooves 36, 37 in which at least the drive electrodes, i.e., the proper individual electrodes 24 and the first and second proper common electrodes 25 are exposed. The first and second side electrodes 34, 35, electrically connected to the drive electrodes, are provided in the first and second side grooves 36, 37, respectively.

The piezoelectric actuator 20 may be employed by not only the ink jet printer head but also different sorts of devices each of which delivers a liquid from a pressure chamber thereof.

In the piezoelectric actuator 20 of the illustrated ink jet printer head, the second common-electrode layer 25*b*, 25*d* is provided on one, or each, of the respective outer surfaces of the opposite outermost layers 21*b*, 21*g* of the piezoelectric layers 21*b*, 21*c*, 21*d*, 21*e*, 21*f*, 21*g*, such that the second common electrode 25*b* is opposed commonly to the pressure chambers 16. Therefore, the stacked body consisting of the piezoelectric sheets 21*b* through 21*g* and the electrode layers 24, 27; 25*a*, 25*c*; 25*b*, 25*d* that are stacked on each other can enjoy an advantage that the variation of thickness of the stacked body, caused by the individual electrodes 24 and the first common electrodes 25*a* that are opposed to the pressure chambers 16, respectively, can be reduced. In addition, the warpage or unevenness of the piezoelectric actuator, after being fired, is reduced, and accordingly the actuator can be fixed in close contact with the object (e.g., a cavity unit) having the pressure chambers. Thus, the present piezoelectric actuator is freed of defects that would otherwise occur thereto.

In the piezoelectric actuator 20 of the illustrated ink jet printer head, each of the pressure chambers 16 has an elongate shape, each of the individual electrodes 24 has an elongate shape overlapping a corresponding one of the pressure chambers 16, and each of the first common electrodes 25*a* has an elongate shape overlapping a corresponding one of the individual electrodes 24 and a corresponding one of the pressure chambers 16. Each pressure chamber 16 has the first width L1, and each individual electrode 24 has the second width L2 not greater than the first width L1. Each first common electrode 25*a* has the third width L3 greater than the second width L2. Therefore, the expansion and contraction of each active portion, i.e., the respective portions of the piezoelectric layers 21*b* through 21*g* that are sandwiched by each individual electrode 24, the corresponding first common electrode 25*a*, and the second common electrode 25*b* can be stably and efficiently transmitted to the corresponding pressure chamber 16. In addition, the width L3 of each first common electrode 25*a* is greater than that of each individual electrode 24. Therefore, even if, when the piezoelectric layers 21*b* through 12*f* having the respective electrode layers 24, 27; 25*a*, 25*c* provided thereon are stacked on each other, each first common electrode 25*a* and the corresponding individual electrode 24 may be more or less deviated from with each other in the widthwise direction of those electrodes, the area of the active portion defined by the each first common electrode 25*a* and the corresponding individual electrode 24 does not change. Accordingly, the amount of deformation or displacement of the active portion is not adversely influenced. Thus, when the piezoelectric sheets 21*b* through 21*g* are stacked on each other in the manufacturing process, those sheets can be easily positioned relative to each other.

In the illustrated ink jet printer head, the active portions of the piezoelectric actuator 20 are aligned with the pressure chambers 16 of the cavity unit 10, respectively. Therefore, the cost of materials of the electrode layers 25*a*, 25*c* of the ink jet printer head can be lowered for the above-described reason, and the warpage or unevenness of the actuator as a whole can be minimized. In addition, the piezoelectric actuator 20 can be fixed in close contact to the cavity unit 10 having the ink chambers 16, such that the active portions of the actuator 20 are opposed to the ink chambers 16, respectively.

It is to be understood that the present invention may be embodied with various changes and improvements that may occur to a person skilled in the art, without departing from the spirit and scope of the invention defined in the appended claims.

What is claimed is:

1. A piezoelectric actuator disposed to face a plurality of pressure chambers, the piezoelectric actuator comprising:

a plurality of piezoelectric layers and a plurality of electrode layers which are alternately stacked on each other; and a plurality of active portions which are provided in the piezoelectric layers to be aligned with the pressure chambers, respectively, and are defined between at least one pair of electrode layers that are opposed to each other in a direction of stacking of the piezoelectric layers and the electrode layers, the active portions being deformed when an electric voltage is applied to the electrode layers, the electrode layers comprising (a) at least one individual-electrode layer including a plurality of individual electrodes which are aligned with the pressure chambers, respectively, (b) at least one first common-electrode layer including a plurality of first common electrodes which are maintained at a common electric potential and are aligned with the pressure chambers, respectively, and (c) at least one second common-electrode layer including at least one second common electrode which is maintained at the common electric potential and is opposed commonly to the plurality of pressure chambers, wherein said at least one second common-electrode layer is provided by at least one of opposite outermost layers of the electrode layers.

2. The piezoelectric actuator according to claim 1, wherein the plurality of active portions in the piezoelectric layers include:

a plurality of first active portions which are aligned with the pressure chambers, respectively, and are sandwiched by the first common electrodes of said at least one first common-electrode layer and the individual electrodes of said at least one individual-electrode layer; and a plurality of second active portions which are aligned with the pressure chambers, respectively, and are sandwiched by said at least one second common electrode and the individual electrodes of said at least one individual-electrode layer, each of the first active portions being deformed together with a corresponding one of the second active portions when an electric voltage is applied to a corresponding one of the individual electrodes, the first common electrodes, and said at least one second common electrode.

3. The piezoelectric actuator according to claim 1, wherein said at least one second common-electrode layer is provided on at least one of respective outer surfaces of opposite outermost layers of the piezoelectric layers each of which has the active portions, such that said at least one second common electrode is opposed commonly to the plurality of pressure chambers.

4. The piezoelectric actuator according to claim 3, wherein the electrode layers comprise (c) two said second common-electrode layers each of which includes at least one second common electrode, which are maintained at the common electric potential, and which are provided on the respective outer surfaces of the opposite outermost layers of the piezoelectric layers, such that said at least one second common electrode of each of the two second common-electrode layers is opposed commonly to the plurality of pressure chambers.

5. The piezoelectric actuator according to claim 4, wherein the electrode layers comprise (a) a plurality of said individual-electrode layers each of which includes a plurality of individual electrodes which are aligned with the pressure chambers, respectively, and (b) a plurality of said first common-electrode layers each of which includes a plurality of first common electrodes which are maintained at the common electric potential and are aligned with the pressure chambers, respectively, and wherein the individual-electrode layers and the first common-electrode layers are each stacked on a corresponding one of the piezoelectric layers, and are provided alternately between the two second common-electrode layers.

6. The piezoelectric actuator according to claim 1, wherein each of the pressure chambers has an elongate shape, each of the individual electrodes has an elongate shape overlapping a corresponding one of the pressure chambers, and each of the first common electrodes has an elongate shape overlapping a corresponding one of the individual electrodes and a corresponding one of the pressure chambers.

7. The piezoelectric actuator according to claim 6, wherein said each pressure chamber has a first width, and said each individual electrode has a second width that is not greater than the first width.

8. The piezoelectric actuator according to claim 7, wherein said each first common electrode has a third width that is greater than the second width.

9. The piezoelectric actuator according to claim 8, wherein the third width is not greater than the first width.

10. The piezoelectric actuator according to claim 1, wherein the piezoelectric actuator is assembled into an ink jet printer head having the pressure chambers, and wherein the active portions are aligned with the pressure chambers of the ink jet printer head, respectively.

11. The piezoelectric actuator according to claim 1, wherein the first common electrodes are formed of silver-palladium alloy.

12. The piezoelectric actuator according to claim 1, wherein said at least one first common-electrode layer and said at least one second common-electrode layer cooperate with each other to sandwich, therebetween, at least two piezoelectric layers of the plurality of piezoelectric layers, and wherein each of said at least two piezoelectric layers has at least one through-hole which is formed through a thickness thereof and is provided with an electrically conductive material such that said at least one first common-electrode layer and said at least one second common-electrode layer are electrically connected to each other.

13. An ink jet printer head, comprising:

a cavity unit having a plurality of ink ejection nozzles and a plurality of ink chambers in each of which an ink is accommodated and each of which communicates with a corresponding one of the ink ejection nozzles; and a piezoelectric actuator which changes a pressure of the ink accommodated in said each ink chamber, so as to eject a droplet of the ink from the corresponding ink ejection nozzle the piezoelectric actuator including a plurality of piezoelectric layers and a plurality of electrode layers which are alternately stacked on each other, and plurality of active portions which are provided in the piezoelectric layers to be aligned with the ink chambers, respectively, and are defined between at least one pair of electrode layers that are opposed to each other in a direction of stacking of the piezoelectric layers and the electrode layers, the active portions being deformed when an electric voltage is applied to the electrode layers, the electrode layers comprising (a) at least one individual-electrode layer including a plurality of individual electrodes which are aligned with the ink chambers, respectively, (b) at least one first common-electrode layer including a plurality of first common electrodes which are maintained at a common electric potential and are aligned with the ink chambers, respectively, and (c) at least one second common-electrode layer including at least one second common electrode which is maintained at the common electric potential and is opposed commonly to the plurality of ink chambers, wherein said at least one second common-electrode layer is provided by at least one of opposite outermost layers of the electrode layers.

14. The ink jet printer head according to claim 13, wherein the plurality of active portions in the piezoelectric layers include:

a plurality of first active portions which are aligned with the ink chambers, respectively, and are sandwiched by the first common electrodes of said at least one first common-electrode layer and the individual electrodes of said at least one individual-electrode layer; and a plurality of second active portions which are aligned with the ink chambers, respectively, and are sandwiched by said at least one second common electrode and the individual electrodes of said at least one individual-electrode layer, each of the first active portions being deformed together with a corresponding one of the second active portions when an electric voltage is applied to a corresponding one of the individual electrodes, the first common electrodes, and said at least one second common electrode.

15. The ink jet printer head according to claim 13, wherein said at least one second common-electrode layer is provided on at least one of respective outer surfaces of opposite outermost layers of the piezoelectric layers each of which has the active portions, such that said at least one second common electrode is opposed commonly to the plurality of ink chambers.

16. The ink jet printer head according to claim 15, wherein the electrode layers comprises (c) two said second common-electrode layers each of which includes at least one second common electrode, which are maintained at the common electric potential, and which are provided on the respective outer surfaces of the opposite outermost layers of the piezoelectric layers, such that said at least one second common electrode of each of the two second common-electrode layers is opposed commonly to the plurality of ink chambers.

17. The ink jet printer head according to claim 15, wherein the piezoelectric actuator is fixed to the cavity unit, such that said one of the respective outer surfaces of the opposite outermost layers of the piezoelectric layers, on which the second common-electrode layer is provided, is nearer to the ink chambers of the cavity unit than the other outer surface.

18. The ink jet printer head according to claim 13, wherein the first common electrodes are formed of silver-palladium alloy.

19. A piezoelectric actuator disposed to face a plurality of pressure chambers, the piezoelectric actuator comprising:

a plurality of piezoelectric layers and a plurality of electrode layers which are alternately stacked on each other; and a plurality of active portions which are provided in the piezoelectric layers to be aligned with the pressure chambers, respectively, and are defined between at least one pair of electrode layers that are opposed to each other in a direction of stacking of the piezoelectric layers and the electrode layers, the active portions being deformed when an electric voltage is applied to the electrode layers, wherein the electrode layers comprise (a) at least one individual-electrode layer including a plurality of individual electrodes which are aligned with the pressure chambers, respectively, (b) at least one first common-electrode layer including a plurality of first common electrodes which are maintained at a common electric potential and are aligned with the pressure chambers, respectively, and (c) at least one second common-electrode layer including at least one second common electrode which is maintained at the common electric potential and is opposed commonly to the plurality of pressure chambers, wherein each of the pressure chambers has an elongate shape, each of the individual electrodes has an elongate shape overlapping a corresponding one-of the pressure chambers, and each of the first common electrodes has an elongate shape overlapping a corresponding one of the individual electrodes and a corresponding one of the pressure chambers, and wherein said each first common electrode has a width that is greater than a width of said each individual electrode.

20. The piezoelectric actuator according to claim 19, wherein the width of said each individual electrode is not greater than a width of said each pressure chamber.

21. The piezoelectric actuator according to claim 19, wherein the width of said each first common electrode is not greater than a width of said each pressure chamber.

* * * * *